US011039970B2

(12) United States Patent
Olszewski et al.

(10) Patent No.: US 11,039,970 B2
(45) Date of Patent: Jun. 22, 2021

(54) ACCESSORY PART WITH CLAMP FASTENING

(71) Applicant: MAQUET GMBH, Rastatt (DE)

(72) Inventors: Jan Donat Olszewski, Rastatt (DE); Dorothee Rathmann, Bühl (DE)

(73) Assignee: MAQUET GMBH, Rastatt (DE)

( * ) Notice: Subject to any disclaimer, the term of this patent is extended or adjusted under 35 U.S.C. 154(b) by 72 days.

(21) Appl. No.: 16/242,462

(22) Filed: Jan. 8, 2019

(65) Prior Publication Data

US 2019/0142676 A1 May 16, 2019

Related U.S. Application Data

(63) Continuation of application No. PCT/EP2017/066485, filed on Jul. 3, 2017.

(30) Foreign Application Priority Data

Jul. 15, 2016 (DE) ..... 10 2016 113 050.8

(51) Int. Cl.
*A61G 13/10* (2006.01)
*A61G 13/12* (2006.01)

(52) U.S. Cl.
CPC ..... *A61G 13/101* (2013.01); *A61G 13/12* (2013.01); *A61G 13/121* (2013.01); *A61G 2210/50* (2013.01)

(58) Field of Classification Search
CPC .. A61G 13/101; A61G 13/12; A61G 13/1205; A61G 13/121; A61G 13/1235;
(Continued)

(56) References Cited

U.S. PATENT DOCUMENTS 4,526,355 A * 7/1985 Moore ..... A61G 13/0063 5/624
4,576,351 A * 3/1986 Brink ..... A47O 7/546 248/118

(Continued)

FOREIGN PATENT DOCUMENTS

| | | |
|---|---|---|
| CN | 1415272 | 5/2003 |
| CN | 105411762 | 3/2016 |
| WO | 2015/081452 A1 | 6/2015 |

OTHER PUBLICATIONS

International Search Report (with English translation) dated Oct. 11, 2017 for corresponding application No. PCT/EP2017/066485, 4 pages.

(Continued)

*Primary Examiner* — Robert G Santos
*Assistant Examiner* — Rahib T Zaman

(57) ABSTRACT

An accessory part for a medical device, such as an operating table or a transport board. Accessory devices may include a first plate for supporting a patient, and a second plate which can be moved relative to the first plate within a predetermined adjustment range. Devices may include a first clamping surface and a second clamping surface at a distance from the first clamping surface, wherein movement of the second plate relative to the first plate causes movement of the second clamping surface relative to the first clamping surface in a direction substantially parallel to a surface of the first or second plate, in order to increase or reduce a clamping force between the accessory part and a suitable holder on the medical device. Methods and medical devices for use with the accessory parts are also disclosed.

19 Claims, 10 Drawing Sheets

(58) Field of Classification Search
CPC ..... A61G 13/124; A61G 13/1245; A61G 13/125; A61G 13/128; A61G 13/0009; A61G 13/0018; A61G 2210/50
See application file for complete search history.

(56) References Cited

U.S. PATENT DOCUMENTS 4,964,400 A * 10/1990 Laico ..... A61G 13/12 128/878
5,697,164 A * 12/1997 Hausmann ..... A61B 5/1071 33/512
5,940,912 A * 8/1999 Keselman ..... A61G 13/1235 297/411.35
7,222,826 B1 * 5/2007 Berglund ..... A47B 21/0314 248/118
8,700,131 B2 * 4/2014 Goff ..... A61B 6/107 600/424
9,125,784 B2 * 9/2015 Crisco ..... A61F 5/3761
9,414,983 B1 * 8/2016 Loli ..... A61G 13/1235
9,636,268 B1 * 5/2017 Bedillion ..... A61G 13/1235
2003/0084512 A1 * 5/2003 Fujita ..... A61B 6/0421 5/601
2010/0263129 A1 * 10/2010 Aboujaoude ..... A61G 13/129 5/650
2013/0193280 A1 * 8/2013 Diamante ..... A61G 13/124 248/118
2015/0101619 A1 * 4/2015 Lassetter ..... A61F 5/3769 128/879
2015/0246186 A1 * 9/2015 Ercan ..... A61B 6/548 600/431
2016/0317371 A1 * 11/2016 Wooden ..... A61G 13/1235
2017/0042751 A1 * 2/2017 Lassetter ..... F16B 45/00

OTHER PUBLICATIONS

Office Action issued in corresponding Chinese Application No. 201780043807.5 dated Jul. 28, 2020 (9pages).

* cited by examiner

ACCESSORY PART WITH CLAMP FASTENING

RELATED CASES

This application claims priority and benefit of international application PCT/EP2017/066485 filed Jul. 3, 2017, and also German application DE 10 2016 113 050.8, filed Jul. 15, 2016.

BACKGROUND

The present disclosure relates for example to an accessory part such as, for example, a head plate, for a medical device such as, for example, an operating table or a transfer board. In particular, the present disclosure relates to an accessory part which is suitable for imaging body parts of a patient supported on the accessory part by imaging methods such as, for example, x-ray images, computer tomography (CT), angiography or magnetic resonance tomography (MRT).

Traditional head plates or leg plates usually comprise struts and fastening mechanisms which can appear in an x-ray image of a patient's body part lying on the plate as artefacts. Furthermore, the position of traditional head or leg plates can often not be continuously adjusted so that an intraoperative fine adjustment of the head plate can be difficult. Furthermore, it can be desirable in the case of other accessory parts such as, for example, leg plates, to adjust the position to fit patients of different sizes.

Furthermore, it is difficult in the case of customary head plates and leg plates to remove, mount or replace the plates while a patient is lying on the transfer board or the operating table without having to lift the patient to do so. Head plates or leg plates are usually fastened on medical devices with peg interfaces which are made of metal and can therefore not be penetrated by radiation.

The disclosure therefore addresses the problem of making an improved accessory part available which can be fastened continuously and securely on a medical device such as, for example, an operating table even if the patient is already lying on it and which otherwise generates as few artifacts as possible in an x-ray image, an angiogram image or a CT image.

Overview of the Disclosure

The previously cited problem is solved by an accessory part for a medical device, in particular for an operating table or for a transport board, comprising a first plate for supporting a body part of the patient, and a second plate which can be moved relative to the first plate within a predetermined adjustment range, a first clamping surface and a second clamping surface at a distance from the first clamping surface. It should be noted here that the second plate does not necessarily have to have the same shape and/or dimensions as the first plate but rather that the second plate can in particular also be distinctly narrower or can be constructed as a structure consisting of one or more struts or the like. In doing so, a movement of the second plate relative to the first plate brings about a movement of the second clamping surface relative to the first clamping surface in a direction substantially parallel to a surface of the first or second plate in order to increase or reduce a clamping force between the accessory part and a suitable holder on the medical device. Therefore, the accessory part can be securely fastened to the medical device by scissors clamping.

In doing so, the movement of the second plate relative to the first plate can be a rotary movement. However, it is also contemplated that the second plate can be shifted relative to the first plate or that a combined rotation and shifting of the second plate relative to the first plate is made.

Furthermore, a support surface can be provided between the first and the second plate, wherein the support surface has a diameter which is smaller than a dimension of width of the first or of the second plate. A low-friction rotary movement of the second plate relative to the first plate about a defined axis of rotation can be obtained by the support surface.

In doing so, the rotation of the second plate relative to the first plate takes place about an axis of rotation running through the support surface. A support disk can be arranged between the first and the second plate which disk forms at least a part of the support surface.

According to a few embodiments, the first clamping surface can be arranged on the first plate and the second clamping surface on the second plate. In this manner a distance between the two clamping surfaces can be adjusted relative to one another by a relative movement of the two plates in order to vary a clamping force.

According to a few embodiments, the accessory part can comprise a third clamping surface on the first plate and a fourth clamping surface on the second plate, wherein upon a movement of the second plate relative to the first plate, the third clamping surface moves relative to the fourth clamping surface. This can achieve an especially secure clamping via the four clamping surfaces.

In doing so, a movement of the second plate relative to the first plate can bring it about that the first and the fourth clamping surfaces contact a first side of the holder on the medical device and that the second and/or the third clamping surface contact a second side of the holder.

According to an alternative embodiment, an accessory part can be made available, wherein the first plate has an insertion area which can be inserted into a suitable holder on the medical device. Furthermore, the plate can also comprise a support area on which the body part of the patient can be supported, or it can be provided that the body part of the patient is supported on the same plate section which also serves as an insertion area. The accessory part can comprise a clamping device for fastening the accessory part onto the medical device, wherein the clamping device comprises at least one clamping element which is rotatably connected to the first plate, and wherein the at least one clamping element is rotated relative to the first plate for fastening the accessory part on the medical device. This achieves a scissor-like clamping, wherein the clamping element on the one side and the plate on the other side can be spread apart by the rotation and can thereby exert a clamping force on a surrounding surface such as, for example, on a receiving groove of the medical device.

The scissor-like clamping makes possible a secure and continuous positioning of the accessory part on the medical device. Here, both a surface of the first plate, or a surface of a projection formed on the first plate, and as a surface of the clamping element or of a projection formed on the second plate are pressed on suitable areas of the medical device.

According to a few embodiments, the two plates and/or the clamping device can be designed in such a manner that they can be inserted into a receiving groove on the medical device. In doing so, the rotation of the at least one clamping element or of the second plate relative to the first plate can bring about a clamping of the accessory part in the receiving groove. Alternatively, the plate and the clamping device can also be designed in such a manner that they are clamped in, for example, between two suitable struts of the medical device without a receiving groove having to be necessarily present. The first and/or the second plate can comprise at least one clamping projection which is arranged on at least one corner of the insertion area. Therefore, it can also be ensured by the shaping of the first and second plates that the insertion area is clamped at the corner areas with the medical device.

According to a few embodiments, the at least one clamping projection of the first and/or of the second plate can have a substantially wedge-shaped cross section, wherein the at least one clamping projection of the first and/or of the second plate can comprise two friction surfaces for contacting the medical device. The first and the second plate can therefore have a substantially wedge-shaped cross section in the area of the respective clamping surfaces, wherein each edge comprises two friction surfaces for contacting the medical device. As a result, surfaces arranged obliquely relative to a surface of the first or second plate can be used for surface clamping so that the accessory part can be securely fixed, for example, in a correspondingly shaped receiving groove of the medical device, wherein the wedge-shaped clamping projections are in contact with two surfaces of the receiving groove. As a result, the wedge-shaped clamping projections can be clamped especially securely in the correspondingly shaped receiving groove.

According to a few embodiments, the clamping device can comprise an actuating lever which brings about a rotation of the second plate and/or of the clamping element relative to the first plate by an actuating mechanism. Therefore, a user can readily loosen or set the clamping with the actuating lever.

In doing so, the actuating lever can be rotatably fastened on the first or on the second plate. The actuating lever can comprise a groove or a slot into which a pin fastened on the second or on the first plate engages. This realizes a cam disk control. The cam track can be formed by the groove or the slot on the actuating lever and the cam can be formed by the pin on the second plate. This can realize an eccentric mechanism by which the first and the second plate can be rotated against one another. Alternatively, the cam can also be formed on the actuating lever and the cam disk, which defines the cam track by a groove or a slot, can be formed on the clamping element or on the first plate.

The groove or the slot in the actuating lever can be formed in such a manner that an actuating force or an actuating moment rises at first when actuating the actuating lever for rotating the second plate relative to the first plate, then reaches a maximum value and drops back to a value under the maximum value before reaching the clamping position of the accessory part. As a consequence, when fixing the accessory part, a user experiences a palpable engaging of the actuating lever if the actuating force exceeds its maximum value and can subsequently move the actuating lever with little force into an end position.

An edge or an edge surface of the groove or of the slot can be elastically deformable so that the groove or the slot can be elastically deformed during the actuation of the actuating lever by the pin. This can compensate manufacturing tolerances by deformation of the groove. To this end, one or more slot-shaped recesses can be provided in the actuating lever which run substantially parallel to an edge of the groove. Alternatively or additionally, other elastic elements can be added into the force flow in order to compensate manufacturing tolerances. For example, the support disk between the two plates can consist of elastic material.

According to a few embodiments, the actuating lever and the actuating mechanism can be arranged in an edge area of the first plate so that a user can then also use the actuating lever without problems if, for example, a patient's head lies on the accessory part head plate.

According to a few embodiments, the first plate, the second plate as well as optionally other components of the accessory part can be manufactured from a material such as, for example, plastic, hard paper (laminated paper, paper-based plastics, and/or phenolic paper) or from a carbon fiber material which is permeable for x-ray radiation, wherein no components are provided in the central area of the first plate which are impermeable for x-ray radiation. Hard paper material which can be used, can be, for example, molded laminate substances marketed by the Elektro Isola company, the "Pertinax" product marketed by the Masterplatex company, or the material marketed under the trademark designation "Proma". This can largely avoid artifacts in an x-ray image of a patient lying on the accessory part.

The second plate can be rotatably connected to the first plate about an axis of rotation located substantially in the middle of the insertion area of the first plate. This can ensure a uniform distribution of the corresponding clamping forces in all corner areas of the two plates.

The rotatable connection can comprise a support disk which is arranged substantially in the middle of the insertion area of the first plate. The support disk can be manufactured from a plastic material which is permeable for x-ray radiation. In particular, the support disk can consist of the same material as the two plates. Furthermore, a loss prevention mechanism can be provided which is arranged in at least one edge area of the insertion area of the first plate and which prevents a separation of the two plates. It is not necessary, due to the separate loss prevention mechanism, to provide screws, rivets or other fastening elements in the area of the support disk for fastening the two plates to one another. The loss prevention mechanism in the edge area of the insertion area does not necessarily have to be permeable for x-ray radiation since no body parts of the patient are usually lying in this edge area so that artefacts in an x-ray image of the edge area have no effect on the quality of the x-ray image of the patient.

Another aspect relates to an interface on a medical device, in particular on an operating table or on a transfer board for receiving an accessory part such as previously described, wherein the interface comprises a receiving groove with a substantially M-shaped cross section, and wherein the accessory part plate and the at least one clamping element can be introduced into the receiving groove.

Furthermore, the present disclosure also relates to a method for the detachable fastening of an accessory part on a medical device, in particular on an operating table or a transfer board, wherein the accessory part comprises a first plate for supporting a body part of the patient and comprises a second plate which can be moved relative to the first plate within a predetermined adjustment range, and comprises a first clamping surface and a second clamping surface at a distance from the first clamping surface. The method comprises the moving of the second plate relative to the first plate as a result of which a movement of the second clamping surface relative to the first clamping surface is brought about in a direction substantially parallel to a surface of the first or of the second plate in order to increase or reduce a clamping force between the accessory part and a suitable holder on the medical device.

The features and actions previously explained in conjunction with the device can also be combined with the method according to the disclosure.

BRIEF DESCRIPTION OF THE DRAWINGS

Exemplary, non-limiting embodiments are described in the following with reference to the attached drawings in which the same reference numerals designate the same elements or elements corresponding to each other.

DETAILED DESCRIPTION

Exemplary embodiments are described in the following description with reference to the drawings. The drawings are not necessarily true to scale but are rather intended to schematically illustrate examples of the particular features.

It should be noted that the features and components described in the following can be combined with each other independently of whether they were described in conjunction with a single embodiment. The combination of features in the respective embodiments serves only to illustrate the basic construction and the function of the claimed device.

Figure 1:
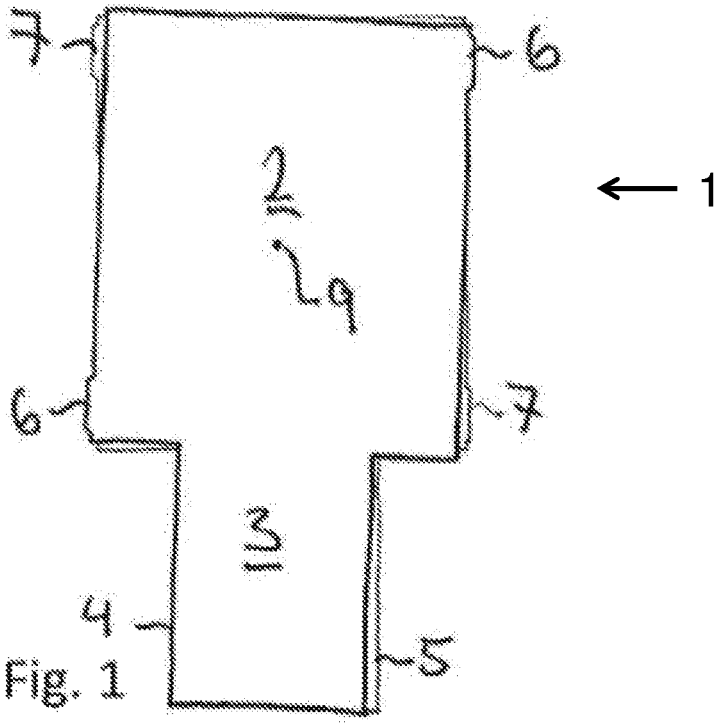
FIG. 1 shows a schematic plan view of an embodiment of an accessory part in the form of a head plate.

FIG. 1 shows a schematic view of the functioning of an accessory part 1 which is designed in this exemplary embodiment as a head plate for use in a transfer board or in an operating table. In particular, the head plate 1 can be used to support the head of a patient during imaging methods such as, for example, CT, and geographic, x-ray images or MRT. As is explained in detail further below, the structure and the composition of the head plate 1 largely minimizes the production of artifacts in an image of the patient lying on it.

The head plate 1 comprises an insertion area 2 with which it can be inserted into a corresponding receptacle of the transfer board or of the operating table. The insertion area 2 is adjoined by a support area 3 which supports the head of a patient. The head plate 1 comprises a first upper plate 4 and a second lower plate 5 which are arranged above one another. As FIG. 1 schematically shows, the first plate 4 and the second plate 5 can be rotated against one another so that clamping projections 6 on the first plate 4 and clamping projections 7 on the second plate 5, respectively, are moved relative to each other.

Figure 2:
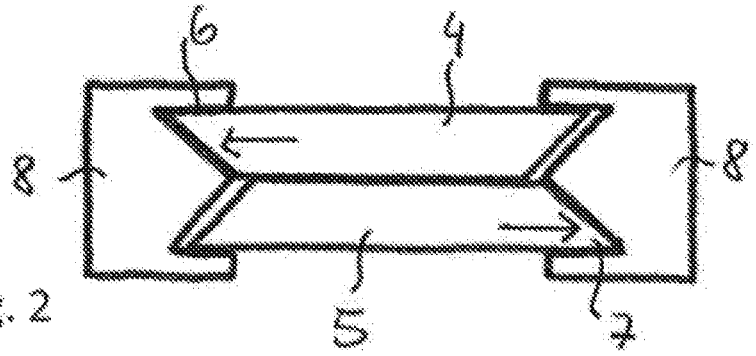
FIG. 2 shows a schematic side elevational illustration of the clamping according to an embodiment.

FIG. 2 illustrates the clamping resulting from the rotation of the two plates 4, 5 against one another: When the insertion area 2 of the head plate 1 is pushed in a reception groove 8 of a transfer board or of an operating table, wedge profiles of the respective clamping projections 6, 7 are introduced into correspondingly shaped sections of the M-shaped reception groove 8 in the embodiment shown here. Therefore, upon a rotation of the two plates 4, 5 relative to one another, a clamping projection 6 of the first plate 4 is pressed on one side against the corresponding surfaces of the reception groove 8 and on the opposite side of the reception groove 8 a clamping projection 7 of the second plate 5 is pressed against the corresponding surfaces of the reception groove 8. This fixes the head plate 1 in the reception groove 8 and automatically centers it in the reception groove 8.

As can be recognized from the schematic view of FIG. 2, the wedge-shaped profile of the clamping projections 6 and 7 and the M shape of the reception groove 8 ensure that each clamping projection is pressed on two of its surfaces against the corresponding inner surfaces of the reception groove 8 in order to achieve a secure fixing of the head plate 1. Furthermore, the arrangement of the oblique surfaces in the wedge profile of the clamping projections 6, 7 and the M shape of the reception groove 8 bring effect that the two plates 4, 5 are spread apart from one another upon a clamping. This can ensure that a rotation of the two plates 4, 5 relative to one another is possible even when the head plate has been clamped in the reception groove 8.

Figure 3:
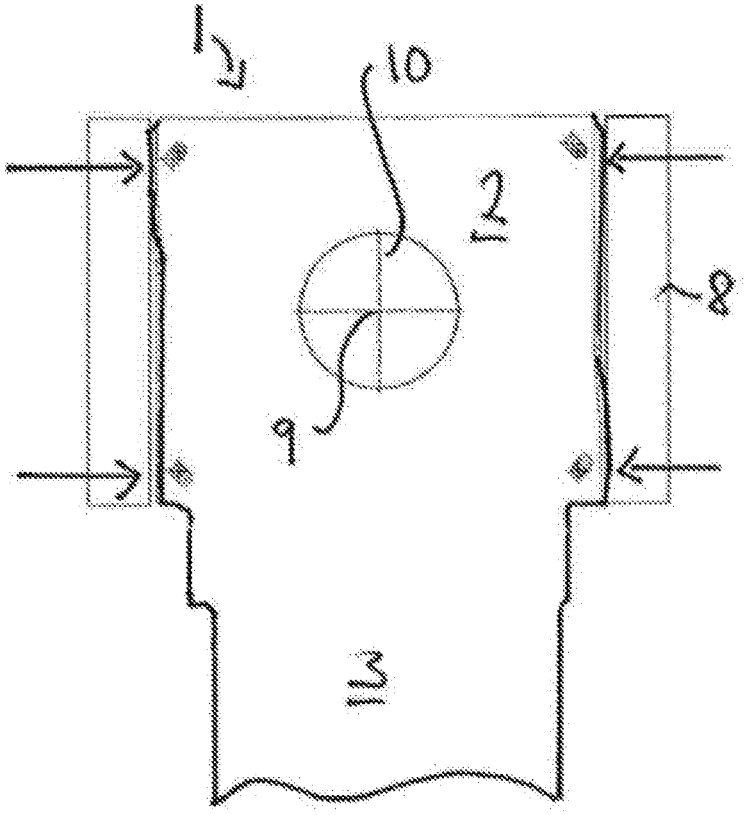
FIG. 3 shows a schematic plan view of the head plate from FIG. 1, which is introduced into a receiving groove of an operating table or of a transfer board.

FIG. 3 shows a schematic top view onto the head plate 1 from FIG. 1, which was introduced into a reception groove 8 of a transfer board or of an operating table. It can be recognized that the clamping takes place on the corners of the insertion area 2 of the head plate 1 whereas the support area 3 of the head plate 1 projects over the transfer board and/or the operating table and therefore makes possible an access without hindrances to the patient's head. Furthermore, an axis of rotation 9 is sketched in FIG. 3 and lies in the middle of the insertion area. As a consequence, the lever arms are equally long for all clamping points so that a symmetric distribution of the corresponding clamping forces is achieved. As FIG. 3 schematically shows, the axis of rotation 9 can be defined by a support disk 10, which is arranged in corresponding receptacles of the surfaces of the first end of the second plate 4, 5, which surfaces face each other.

In order to avoid as much as possible artefacts in images of a patient lying on the head plate 1 during imaging processes, the two plates 4, 5 and the support disk 10 can be made of hard paper or of another material which is permeable for the radiation used in x-ray images or in CT or angiography images. The support disk 10 is designed as a separate structural component in the embodiment shown but can also be integrated into one of the two plates 4, 5.

Figure 4:
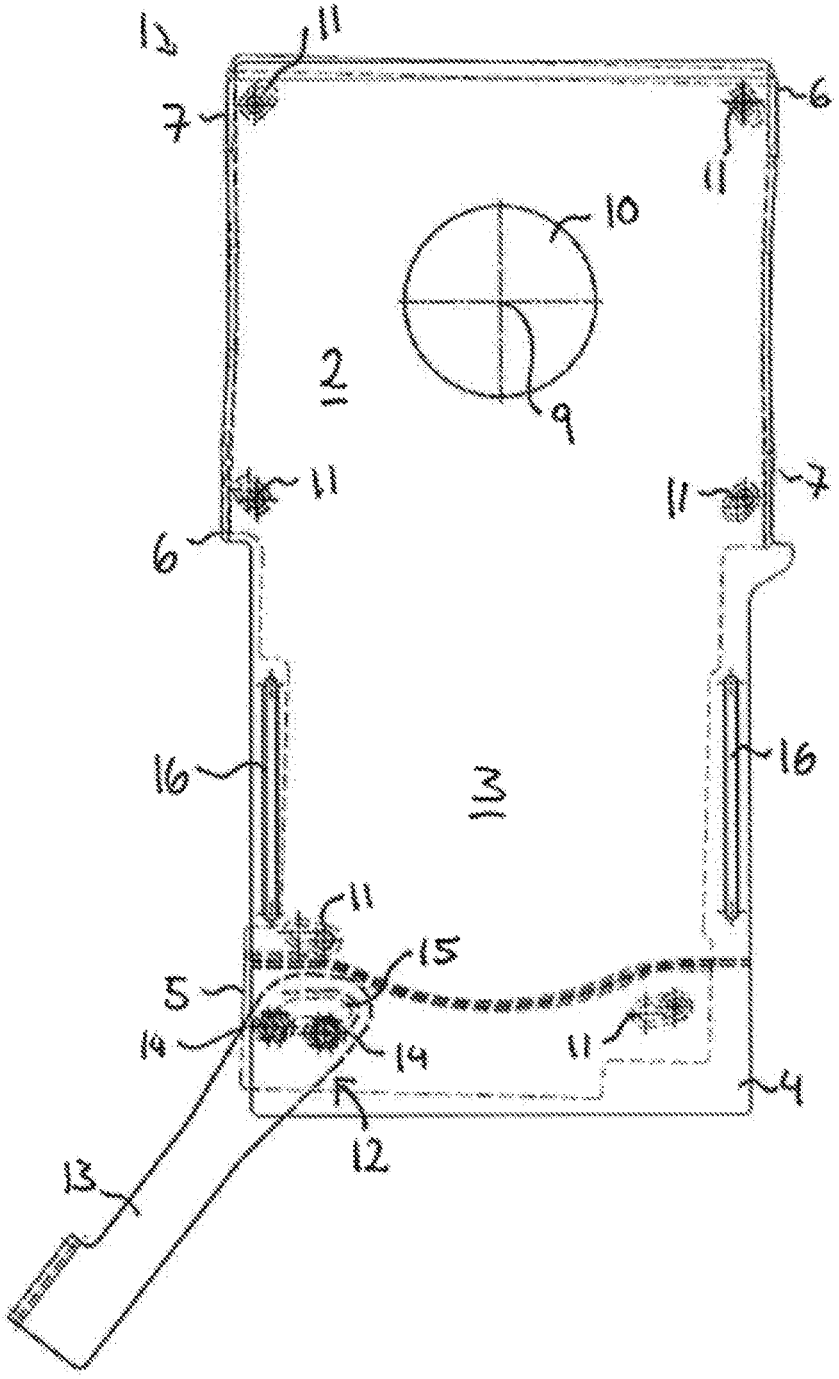
FIG. 4 shows a top plan view of a head plate in an open state of a clamping device.

FIG. 4 shows a top view onto a head plate 1 according to an embodiment in a non-locked state. The first plate 4 and the second plate 5 are aligned with one another in a starting position in which in the insertion area 2 the edges of the two plates 4, 5 run substantially parallel to one another in order to facilitate insertion of the head plate 1 into the reception groove 8 (see FIGS. 2 and 3). In doing so, the clamping projections 6, 7 of the two plates 4, 5 are arranged substantially flush with the respective edge of the adjacent plate 4, 5.

Figure 5:
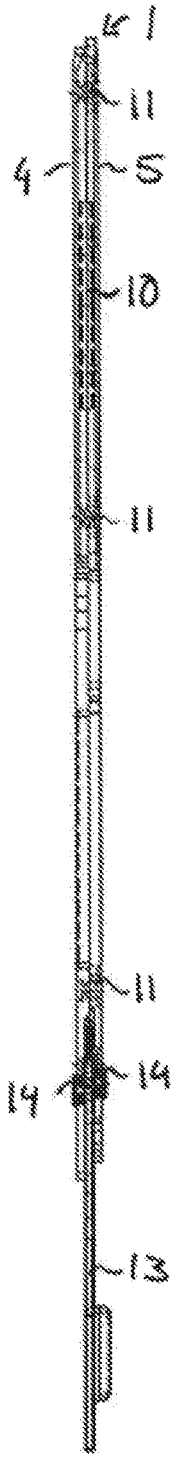
FIG. 5 shows a side view of the head plate from FIG. 4.

As can be recognized from the associated side view of FIG. 5, the support disk 10 is inserted solely between the two plates 4, 5. In order to prevent an unintended falling apart of the head plate 1, loss prevention mechanisms 11 can therefore be provided in the edge areas of the insertion area 2. In the example shown, each loss prevention mechanism 11 comprises a bolt which is fastened to one of the two plates 4, 5 and engages into a groove on the other one of the two plates 4, 5. Therefore, the loss prevention mechanisms 11 make possible the rotary movement of the two plates 4, 5 relative to one another in that the bolt slides in the appropriately shaped groove of the loss prevention mechanism 11. Other loss prevention mechanisms 11 can also be provided in the edge areas of the support area 3 of the head plate 1.

An actuating mechanism 12 for rotating the two plates 4, 5 against one another about the axis of rotation 9 is arranged in the embodiment shown on an end of the support area 3 of the head plate 1. The actuating mechanism 12 comprises an actuating lever 13 which effects the rotation of the two plates 4, 5 relative to one another by an eccentric mechanism 14, 15. Pins 14 are fastened on the two plates 4, 5 of which one pin 14 defines an axis of rotation of the actuating lever 13 and the other pin 14 is guided in a groove or a slot 15 in the actuating lever 13. The shaping of the groove or of the slot 15 of the actuating lever 13 is described in detail further below in conjunction with FIGS. 8 and 9.

As is apparent in the side view of FIG. 5, the actuating lever 13 is arranged in the embodiment shown in the plane of the two plates 4, 5 and is dimensioned in such a manner that it does not extend over the upper and lower surfaces of the two plates 4, 5. The arrangement of the actuating mechanism 12 on the end of head plate 1 facing away from the insertion area 2, effects, on the one hand, that only slight actuating forces have to be applied through the large distance between actuating lever 13 and axis of rotation 9. On the other hand, this means that the actuating Maquet mechanism 12 is also arranged outside of an image area in which images of a patent arranged on the head plate 1 are recorded. Therefore, any bolts or edges of the actuating mechanism 12 that are present cannot produce artifacts in an x-ray image or the like.

In the example shown here, slots 16 are provided in the support area 3 of the first plate 4 of the head plate. These slots can be used to fasten other accessory components.

Figure 6:
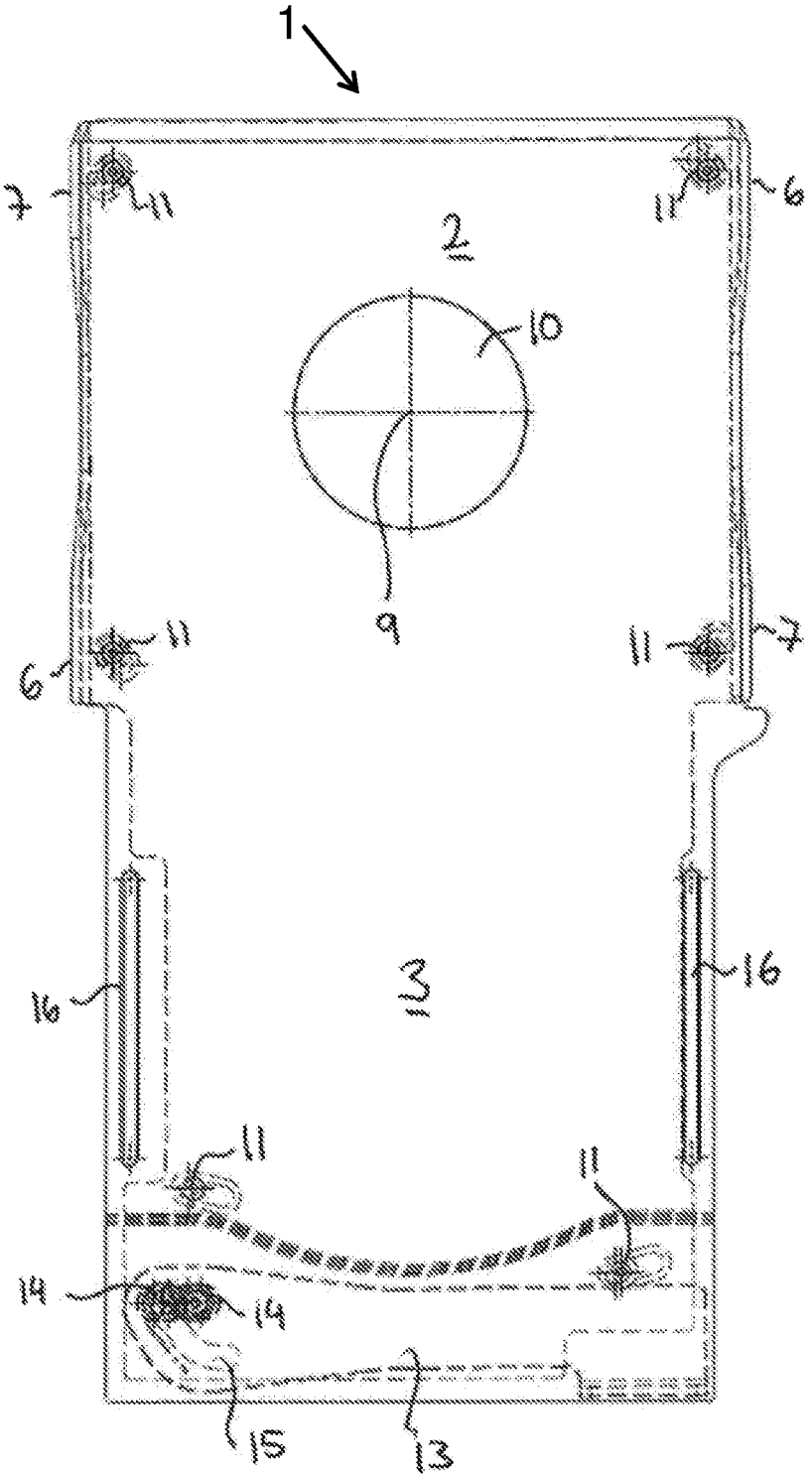
FIG. 6 shows a top plan view of a head plate of FIG. 4 in a closed state of the clamping device.
Figure 7:
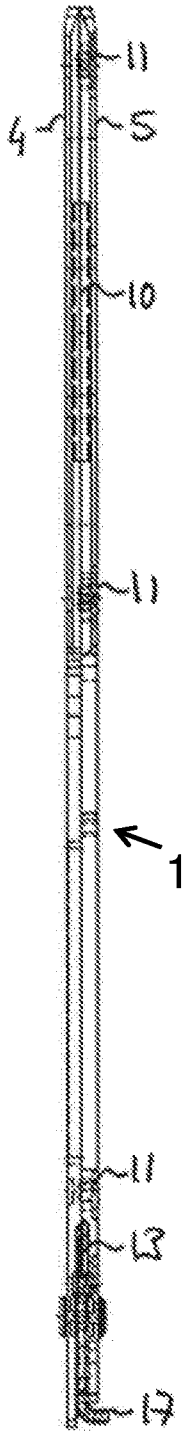
FIG. 7 shows a side view of the head plate from FIG. 6.

FIGS. 6 and 7 show a top view and a side view of the head plate 1 from FIGS. 4 and 5, wherein, however, the actuating lever 13 was rotated into its locked position so that the two plates 4, 5 are rotated against one another and the clamping projections 6, 7 extend over the edges of the bordering plate, respectively. Therefore, the head plate 1 can be fixed in a reception groove 8, as is shown in FIG. 2.

As can be seen from FIGS. 6 and 7, the actuating lever 13 does not project in its locked position over the outer dimensions of the upper plate 4, neither laterally nor upward or downward. Therefore, the actuating lever 13 is not visible from above in its locked position. It can be recognized in FIG. 7 that the two plates 4, 5 become thinner from their separating plane in the area of the actuating lever 13 so that the actuating lever 13 can be received between the two plates. A projection 17 on one end of the actuating lever 13 makes it possible for the user to grasp the actuating lever 13 in its locked position and to move it back into the open position shown in FIG. 4 for loosening the clamping.

Figure 8:
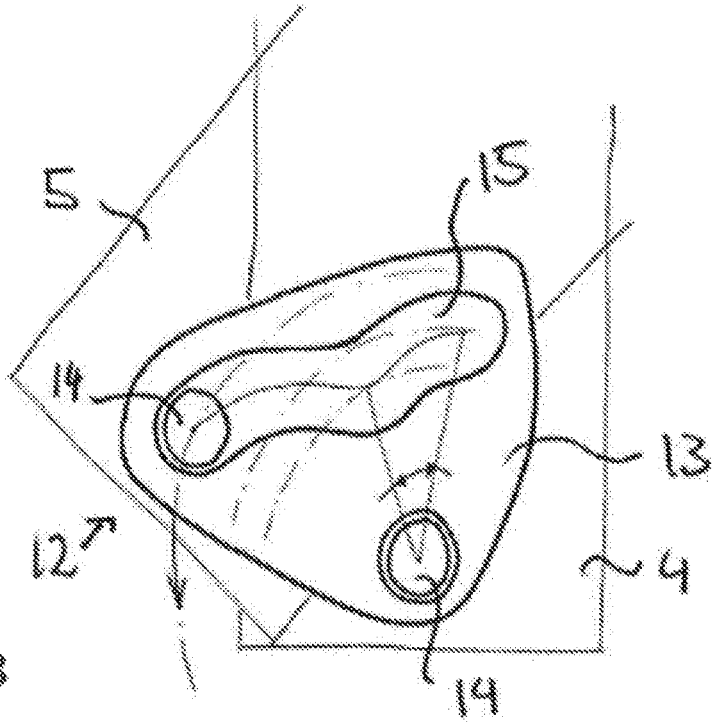
FIG. 8 shows a detailed close-up view of a lever mechanism according to an embodiment.
Figure 9:
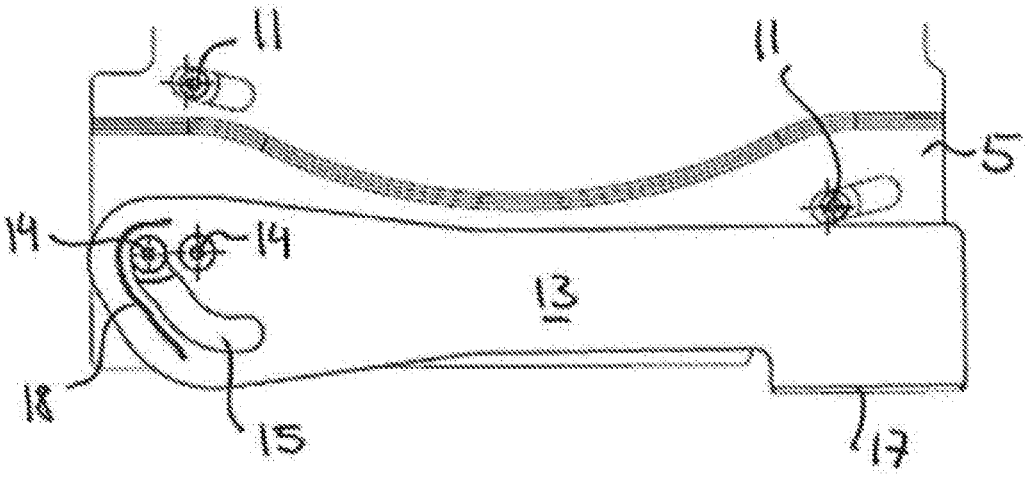
FIG. 9 shows a detailed close-up view of a lever mechanism according to another embodiment.

FIGS. 8 and 9 show detailed views of the actuating mechanism 12. In the schematic view of FIG. 8 a first pin 14, which defines the axis of rotation of the actuating lever 13, is fastened on the upper plate 4 and a second pin 14, which is fastened on the lower plate 5, is guided in the groove 15 of the actuating lever 13. As a result of the shaping of the groove 15, the course of the force and/or momentum can be influenced during the movement of the actuating lever 13 from its open position (see FIG. 4) into its locked position (see FIG. 6).

A simple example for such a shaping would be a groove shaped like a section of a circle, which would achieve a uniform actuating force over the entire adjustment path of the actuating lever 13. However, it would be difficult for a user—in the case of a uniform force course—to estimate when a secure fixing of the head plate 1 is achieved in the reception groove. Furthermore, the actuating lever 13 would then have to be secured in its locking position in order to prevent an unintended loosening of the clamping.

Therefore, according to some embodiments, a shaping of the groove 15 is selected with which an actuating force first increases upon the moving of the actuating lever 13 from its open position into its locked position in order to then drop again before reaching the locked position. This results for the user in a palpable engaging of the actuating lever in a position in which a clamping of the head plate 1 in the reception groove 8 has already been reached. Furthermore, it can be provided that the actuating force remains at a relatively low value after exceeding the maximum value so that the user can move the actuating lever with little expenditure of force after the "engaging" of the clamping on the last part of the adjustment path into the locked position (see FIG. 6).

In this manner, the user can make sure both tactual and visual that the head plate 1 is securely fixed in the reception groove 8 in that he feels the overcoming of the point of maximum actuating force when moving the actuating lever 13 and subsequently can move the actuating lever 13 with little expenditure of force into its end position in the locked position. Furthermore, an unintended loosening of the clamping can be avoided with this force course since during withdrawing of the actuating lever 13 from the locked position into the open position a point of maximum actuating force must again be overcome.

FIG. 9 illustrates another aspect of the actuating mechanism 12 according to a few embodiments. A slot-shaped recess 18 is provided here in the actuating lever 13 and runs substantially parallel to an edge of the groove 15. As a result, this edge of the groove 15 can be elastically deformed so that manufacturing tolerances of the head plate 1 or of the reception groove 8 can be compensated by an elastic deformation of the groove 15 when adjusting the actuating lever 13.

Figure 10A:
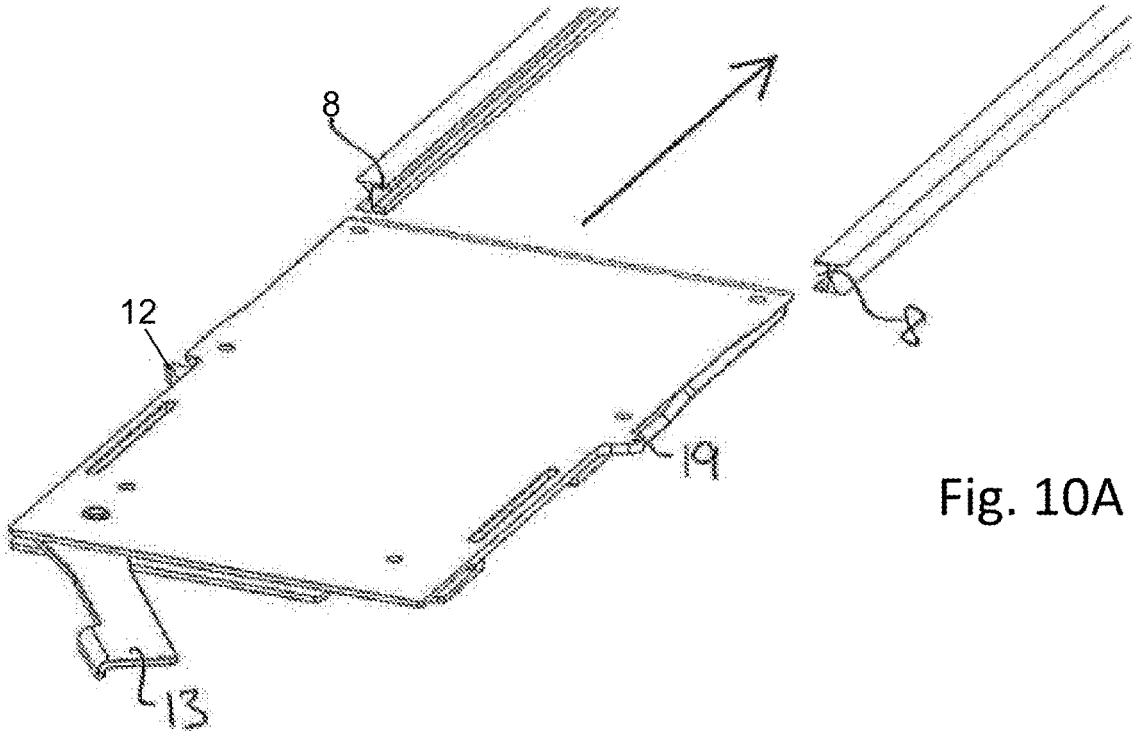
FIGS. 10A-10B illustrate insertion of a head plate according to an embodiment into a receiving groove of an operating table or of a transfer board.
Figure 10B:
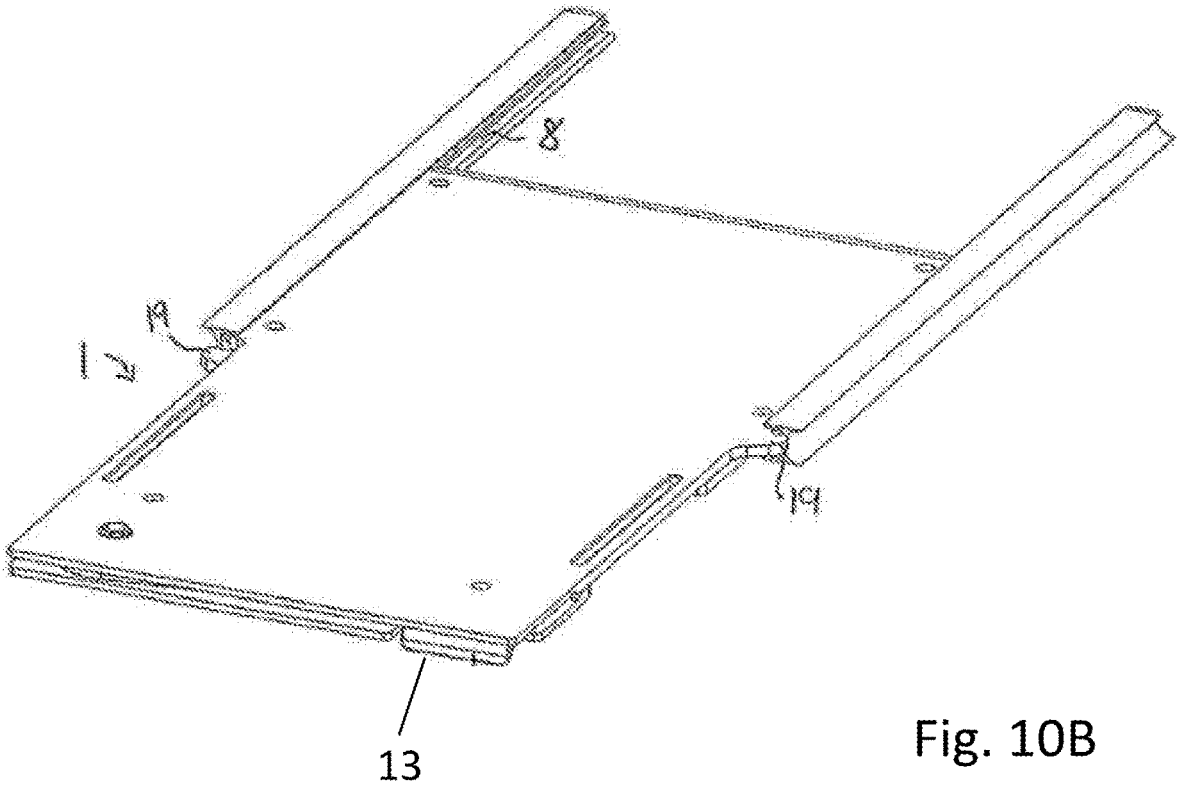
Figure 11A:
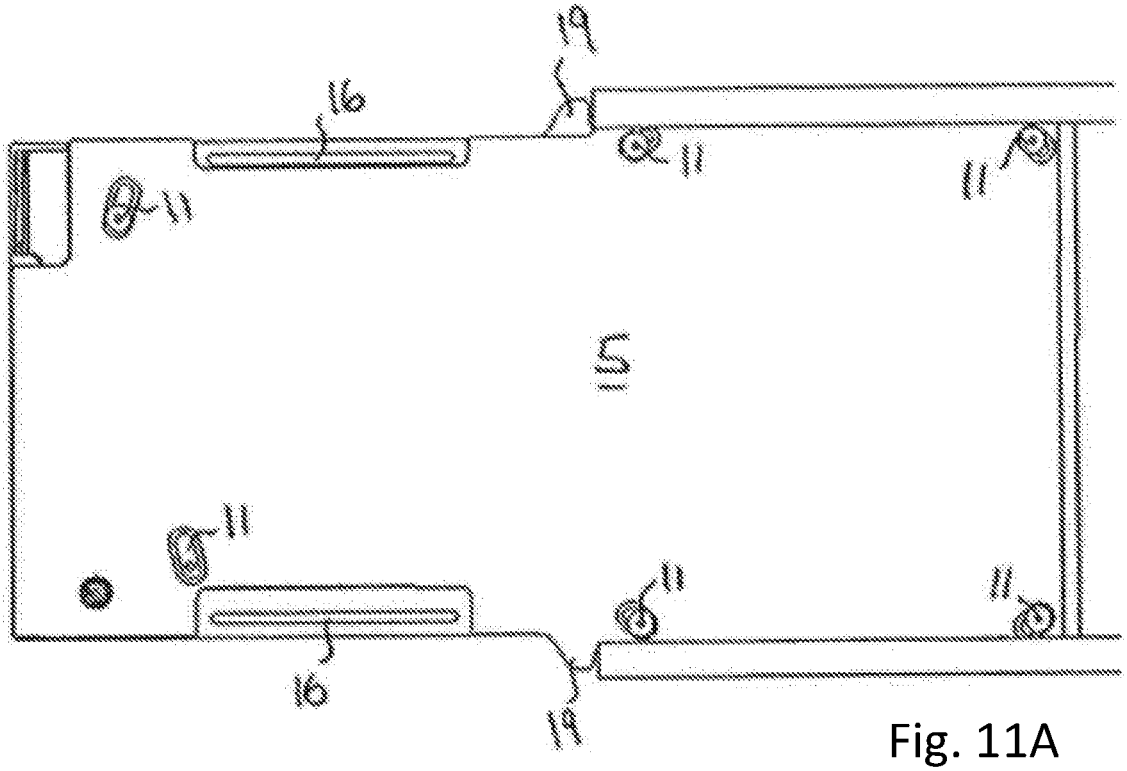
FIGS. 11A-11B show top views of the head plate in FIGS. 10A-10B which is introduced into the receiving groove.
Figure 11B:
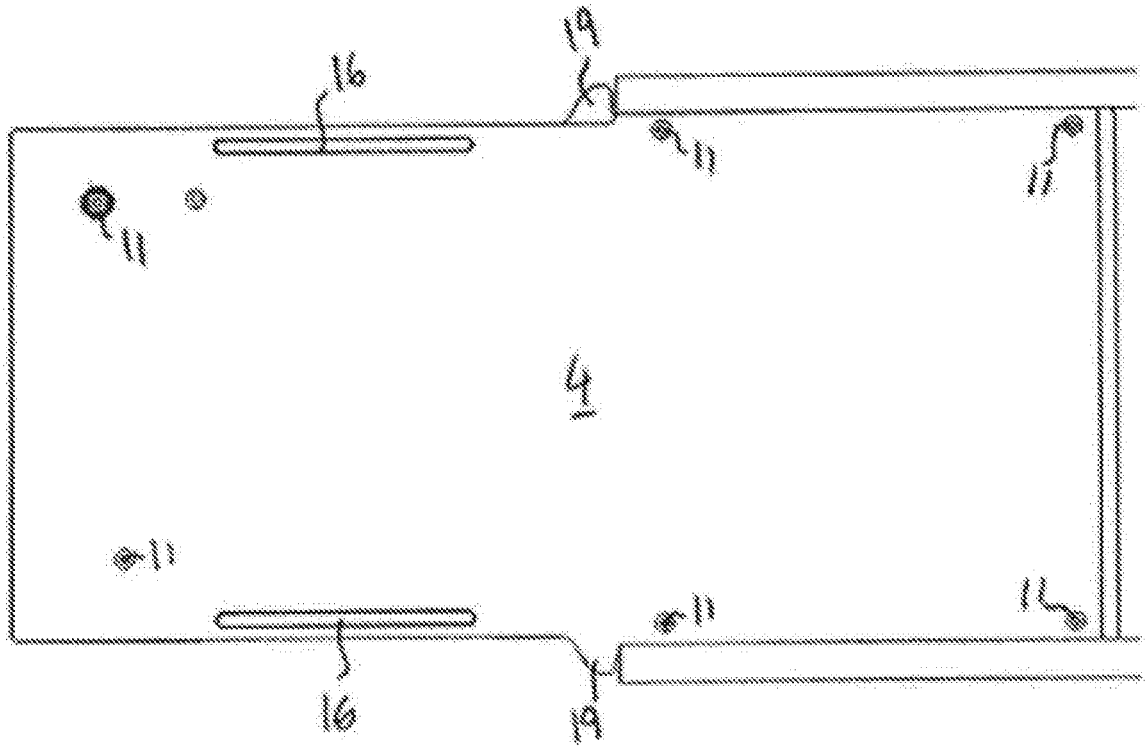

As FIGS. 10 and 11 show, stop projections 19 can be provided on the two plates 4, 5 which limit an insertion depth of the head plate 1 into the reception groove 8. Furthermore, FIG. 11 shows that the loss prevention mechanisms 11 are provided only in edge areas of the head plate 1 so that an area of head plate 1 in which a patient's head is lying, is free of components which could generate artifacts in an image.

Figure 12A:
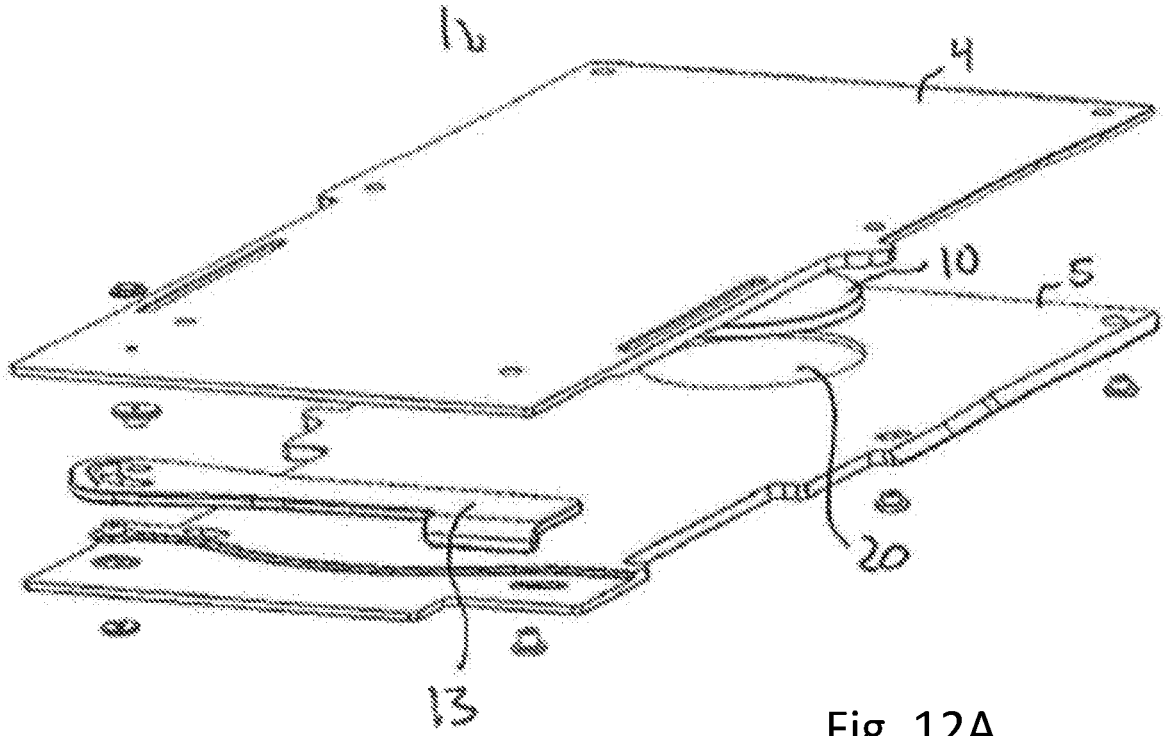
FIGS. 12A-12B show exploded views of the head plate in FIGS. 10A-10B.
Figure 12B:
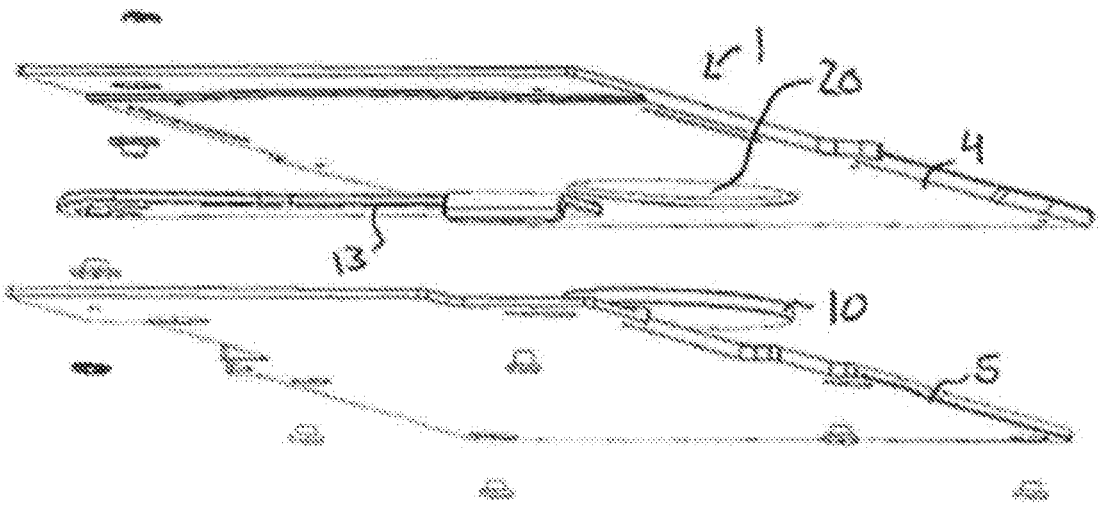
Figure 13:
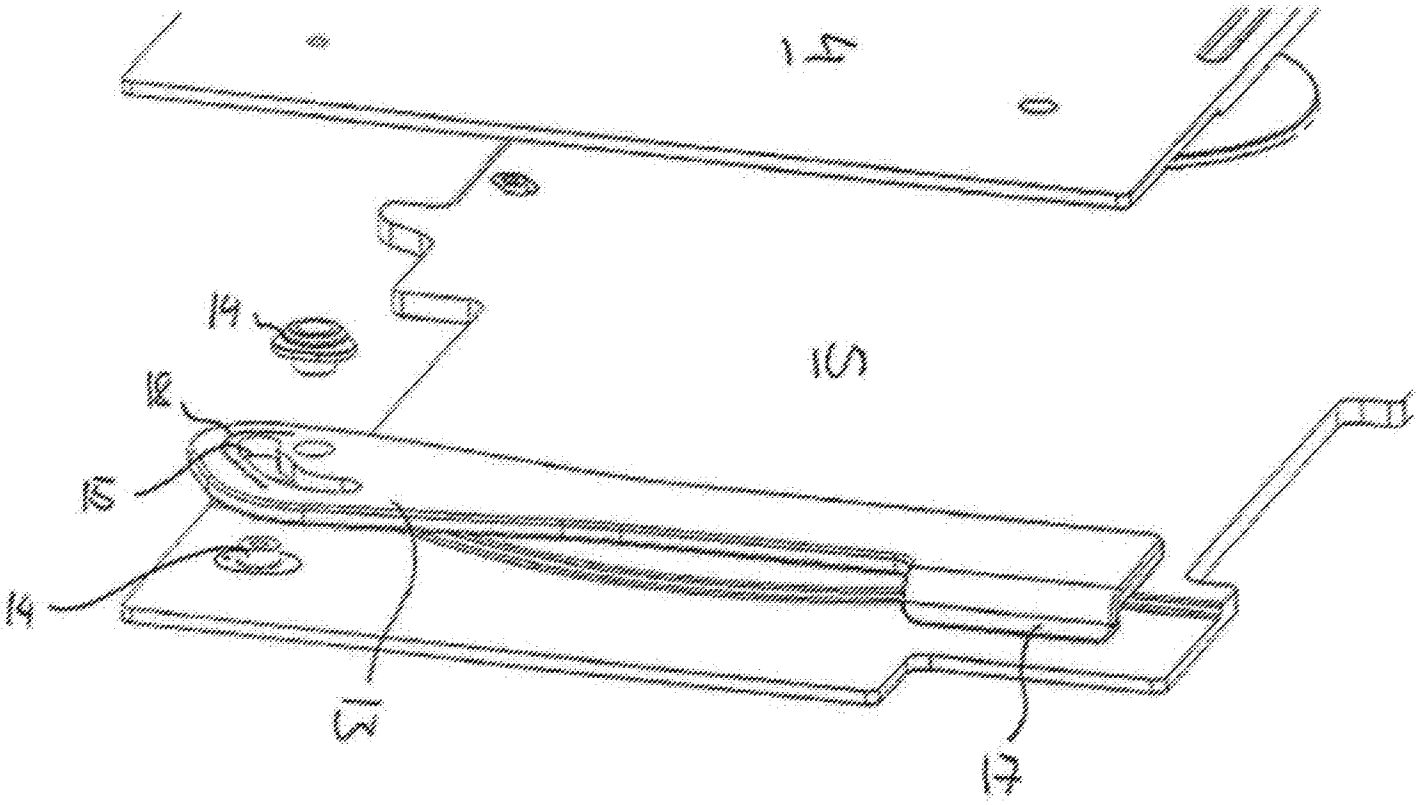
FIG. 13 is a detailed partially exploded view of the actuating lever from FIGS. 12A-12B.

FIG. 12 illustrates the position and the function of the support disk 10. It can be seen from the exploded view of FIG. 12 that the support disk 10 is received in round recesses 20 on the insides of plates 4 and 5. The surfaces of the support disk 10 and the surfaces of the recesses 20 form support surfaces for the rotary movement of the two plates 4, 5 relative to one another. Furthermore, it is apparent from FIG. 12 that no fastening elements are provided on the plates 4, 5 in the area of the support disk 10. As a consequence, artefacts can be avoided in images of the head of a patient. At the same time, the axis of rotation 9 is defined by the support disk 10 and the round recesses 20 in the particular inside of the plates 4, 5.

Figure 14:
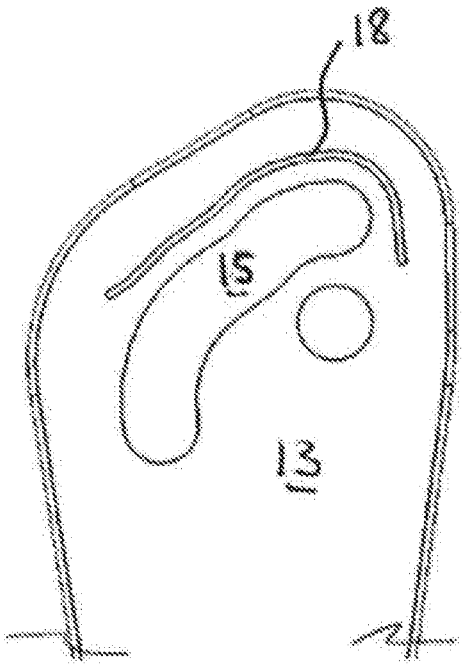
FIG. 14 shows part of an actuating lever.
Figure 15:
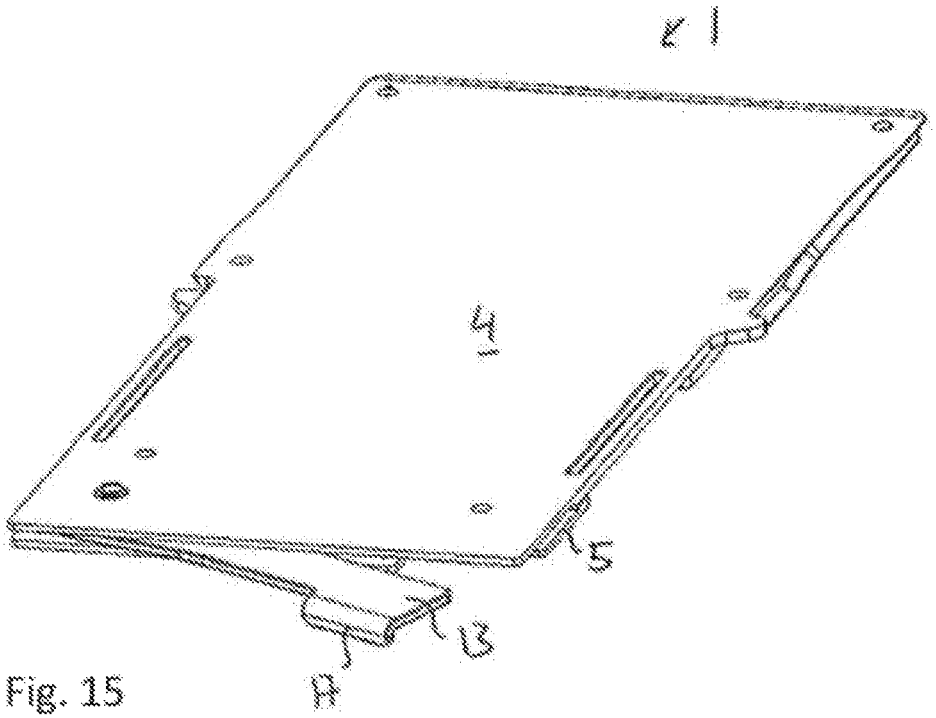
FIG. 15 shows a head plate in which the actuating lever has not yet been brought into its end position.

FIGS. 13 to 16 illustrate the arrangement and the function of the actuating mechanism 12 with the actuating lever 13. It is apparent from FIG. 13 that, depending on the design of the actuating lever, the cam which is guided in the groove or in the slot 15 in the actuating lever is placed on the first or on the second plate 4, 5, wherein the actuating lever 13 can then be rotatably fastened on the respective other plate. In FIG. 14 the shape of the groove or of the slot 15 with which the course of the force or of the Maquet momentum is shown, is enlarged. It can be seen here that the engagement point of the actuating lever can be obtained by an appropriately shaped section in the groove or in the slot 15. FIG. 15 shows the actuating lever in a position in which it can be moved without a great expenditure of force, after having passed the engagement point, into its end position which is shown, for example, in FIG. 13.

In sum, the head plate 1 of the embodiments described above therefore makes possible a simple assembly and disassembly in the reception groove 8 by inserting and clamping by means of the actuating mechanism 12 without the patient having to be lifted. The scissor-like clamping of the head plate 1 in the reception groove 8 facilitates a continuous positioning of the support area 3 of the head plate 1 in the longitudinal direction of the reception groove 8 for different sizes of patients or for different lying positions of a patient.

The head plate 1 can be manufactured almost completely from an x-ray-permeable material such as, for example, from hard paper, plastic or carbon fibers in order to largely avoid artifacts in an x-ray image, a CT image or an angiographic image of a patient whose head rests on the head plate 1. The head plate 1 comprises only a few pins or bolts and they are all arranged in edge areas of the head plate 1 so that they cause no problems in imaging processes.

As a result of the wedge shape of the clamping projections 6, 7 on the two plates, every clamping projection is clamped in by a two-surface clamping in the corresponding M-shaped reception groove 8. This effects an especially secure fixing of the head plate 1 since each clamping projection 6, 7 is pressed with two friction surfaces against corresponding surfaces of the reception groove 8.

Two plates 4, 5 are provided in the previously described embodiments. It would also be conceivable as an alternative that the head plate comprises only a single plate on which a clamping device which is not necessarily plate-shaped such as, for example, a diagonally running beam with clamping projections or clamping elements is rotatably fastened.

A scissor-like clamping on the corners of an insertion area of a head plate such as previously described could also be achieved with another element which is not plate-shaped. However, the embodiment shown here with two plates 4, 5 has the advantage that the structure is overall relatively homogeneous in an area in which the patient is lying and therefore generates fewer artifacts in an x-ray image or the like.

An eccentric mechanism can be used as in the previously described embodiments in order to rotate the two plates 4, 5 against one another. Alternatively, a spindle mechanism or the like can also be used.

Embodiments of this disclosure may include an accessory part (1) for a medical device, in particular for an operating table or for a transport board, including at least a first plate (4) for supporting a body part of a patient, and a second plate (5) which can be moved relative to the first plate (4) within a predetermined adjustment range, and having a first clamping surface and a second clamping surface at a distance from the first clamping surface.

In some embodiments a movement of the second plate (5) relative to the first plate (4) brings about a movement of the second clamping surface relative to the first clamping surface in a direction substantially parallel to a surface of the first or second plate (4, 5), in order to increase or reduce a clamping force between the accessory part and a suitable holder (8) on the medical device. The movement of the second plate (5) relative to the first plate (4) may, for example, be a rotary movement.

Some embodiments include a support surface between the first and the second plate (4, 5). The support surface may have a diameter which is smaller than a dimension of width of the first or of the second plate (4, 5). For example, not more than ¾ or not more than ½ the width of the first or second plate. In some embodiments the rotation of the second plate relative to the first plate takes place about an axis of rotation running through the support surface. There may also be a support disk (10) between the first and the second plate (4, 5) where the support disk (10) forms at least a part of the support surface.

A first clamping surface may arranged on the first plate (4) and a second clamping surface can be arranged on the second plate (5). Some embodiments include a third clamping surface on the first plate (4) and a fourth clamping surface on the second plate (5), so that upon a movement of the second plate (5) relative to the first plate (4) the third clamping surface moves relative to the fourth clamping surface.

In some embodiments a movement of the second plate (5) relative to the first plate (4) results in the first and the fourth clamping surfaces contacting a first side of the holder (8) on the medical device, and the second and/or the third clamping surfaces contacting a second side of the holder (8).

The first and the second plate (4, 5) may be configured so that they can be inserted by an insertion area (2) into a reception groove (8) on a medical device, and so that a rotation of the second plate (5) relative to the first plate (4) brings about a clamping of the accessory part (1) in the reception groove (8).

The first and/or the second clamping surfaces may for example be provided on a clamping projection (6) which is arranged on at least one corner of the insertion area (2).

The first and/or the second plates (4) may have a substantially wedge-shaped cross section in the area of the clamping surfaces, such that a wedge comprises two friction surfaces for contacting the medical device.

The clamping device may include an actuating lever (13) which brings about a rotation of the second plate (5) relative to the first plate (4) by an actuating mechanism (12). In some embodiments, the actuating lever 13 is rotatably fastened on the first and/or on the second plates (4, 5) and comprises a groove (15) into which a pin (14), which is fastened on the second or on the first plate (5, 4), engages. In some embodiments, the groove (15) in the actuating lever (13) is formed in such a manner that an actuating force rises when first actuating the actuating lever (13) for rotating the clamping element (5, 7) relative to the first plate (4), then reaches a maximum value, and then drops back to a value under the maximum value before reaching the clamping position of the accessory part (1). In some embodiments an edge of the groove (15) is resilient or elastic and can be elastically deformed so that the groove (15) can be elastically deformed during the actuation of the actuating lever (13) by the pin (14). A slot-shaped recess (18) may be provided in the actuating lever (13) running substantially parallel to an edge of the groove (15). The actuating lever (13) and the actuating mechanism (12) may be arranged for example in an edge area of the first plate (4).

The first and the second plate (4, 5) are manufactured from a material such as, for example, plastic, hard paper, or a carbon fiber material which is permeable for x-ray radiation. In some embodiments no components are provided in the central area of the first plate (4) which are impermeable for x-ray radiation.

Some embodiments include a loss prevention mechanism (11) which is arranged in at least one edge area of an insertion area (2) of a first plate (4), and wherein the two plates (4, 5) are fastened to one another by the loss prevention mechanism (11).

The disclosure includes medical devices, and interfaces on medical devices for use with accessory parts disclosed herein. This disclosure includes methods of using and connecting accessory parts disclosed herein and medical devices. Exemplary medical devices include operating tables and transfer boards. Interfaces on medical devices for engaging the accessory parts may include a receiving groove (8). The receiving groove may have, for example, a substantially M-shaped cross section, wherein the first and the second plate (4, 5) of the accessory part (1) can be introduced into the receiving groove (8) for connection therewith.

The disclosure includes methods of operating, engaging, and connecting accessory parts using an actuating lever (13).

The disclosure also contemplates arrangements and kits including accessory parts and patient tables, operating tables, and/or transfer boards having interfaces shaped for receiving any of the accessory parts disclosed herein. For example, patient tables, operating tables, or transfer boards having an interface comprising a receiving groove with a substantially M-shaped cross section, and wherein the first and the second plate of the accessory part are shaped to be introduced into the receiving groove.

The invention claimed is:

1. An accessory part for a medical device, for an operating table or for a transport board, comprising: a first plate for supporting a body part of a patient, and a second plate which can be moved relative to the first plate within a predetermined adjustment range, and comprising a first clamping surface of the first plate and a second clamping surface of the second plate at a distance from the first clamping surface, wherein a rotational movement of the second plate relative to the first plate brings about a movement of the second clamping surface relative to the first clamping surface in a direction substantially parallel to a top or bottom surface of the first or second plate and thereby increases or reduces a clamping force between the accessory part and a suitable holder on the medical device.

2. The accessory part according to claim 1, further comprising a support surface between the first and the second plate, wherein the support surface has a diameter which is smaller than a dimension of width of the first or of the second plate.

3. The accessory part according to claim 2, wherein the rotation of the second plate relative to the first plate takes place about an axis of rotation running through the support surface.

4. The accessory part according to claim 3, comprising a support disk which is arranged between the first and the second plate wherein the support disk forms at least a part of the support surface.

5. The accessory part according to claim 1, wherein the first clamping surface is arranged on the first plate and the second clamping surface is arranged on the second plate.

6. The accessory part according to claim 1, further comprising a third clamping surface on the first plate and a fourth clamping surface on the second plate, wherein upon a movement of the second plate relative to the first plate the third clamping surface moves relative to the fourth clamping surface.

7. The accessory part according to claim 6, wherein a movement of the second plate relative to the first plate results in the first and the fourth clamping surfaces contacting a first side of the holder on the medical device and the second and/or the third clamping surfaces contacting a second side of the holder.

8. The accessory part according to claim 1, wherein the first and the second plate are configured so that they can be inserted by an insertion area into a reception groove on the medical device, and wherein the rotation of the second plate relative to the first plate brings about a clamping of the accessory part in the reception groove.

9. The accessory part according to claim 8, wherein the first and/or the second clamping surface is provided on a clamping projection which is arranged on at least one corner of the insertion area.

10. The accessory part according to claim 8, wherein the first and the second plate have substantially wedge-shaped cross sections in the area of the clamping surfaces, wherein each wedge comprises two friction surfaces for contacting the medical device.

11. The accessory part according to claim 1, further comprising a clamping device that comprises an actuating lever configured to cause a rotation of the second plate relative to the first plate by an actuating mechanism.

12. The accessory part according to claim 11, wherein the actuating lever is rotatably fastened on the first or on the second plate and comprises a groove into which a pin, which is fastened on the second or on the first plate, engages.

13. The accessory part according to claim 12, wherein the groove in the actuating lever is formed in such a manner that an actuating force rises when first actuating the actuating lever for rotating the second plate relative to the first plate, then reaches a maximum value, and drops back to a value under the maximum value before reaching a second position of the accessory part.

14. The accessory part according to claim 12, wherein an edge of the groove can be elastically deformed so that the groove can be elastically deformed during the actuation of the actuating lever by the pin.

15. The accessory part according to claim 14, wherein a slot-shaped recess is provided in the actuating lever which runs substantially parallel to an edge of the groove.

16. The accessory part according to claim 11, wherein the actuating lever and the actuating mechanism are arranged in an edge area of the first plate.

17. The accessory part according to claim 1, wherein the first and the second plate are manufactured from at least one of plastic, hard paper, or a carbon fiber material which is permeable for x-ray radiation; and wherein no components are provided in the central area of the first plate which are impermeable for x-ray radiation.

18. The accessory part according to claim 1, wherein a loss prevention mechanism is provided which is arranged in at least one edge area of the insertion area of the first plate, and wherein the two plates are fastened to one another by the loss prevention mechanism.

19. An arrangement comprising:

the accessory part according to claim 1; and an operating table for use with the accessory part, the operating table comprising an interface for interfacing with the accessory part;

wherein the interface comprises a receiving groove with a substantially M-shaped cross section, and wherein the first and the second plate of the accessory part are shaped to be introduced into the receiving groove.

* * * * *